US006158130A

United States Patent [19]

Chong

[11] Patent Number: 6,158,130

[45] Date of Patent: Dec. 12, 2000

[54] INDUSTRIAL CAN OPENER

[76] Inventor: Wun C. Chong, 69 Wallace Place, Delta, British Columbia, Canada, V4M 3S2

[21] Appl. No.: 09/244,202

[22] Filed: Feb. 4, 1999

[51] Int. Cl.[7] ..... B67B 7/46; B67B 7/72

[52] U.S. Cl. ..... 30/418; 30/416; 30/417; 30/419; 30/425; 29/426.4

[58] Field of Search ..... 30/400, 409, 410, 30/416, 417, 418, 419, 420, 421, 422, 423, 424, 425, 428, 433, 434; 29/426.2, 426.3, 426.4, 426.5; 83/946

[56] References Cited

U.S. PATENT DOCUMENTS

| | | | |
|---|---|---|---|
| Re. 27,504 | 10/1972 | Smith . | |
| 1,393,412 | 10/1921 | Waller | 30/418 |
| 1,405,066 | 1/1922 | Nicolai | 30/418 |
| 1,424,960 | 8/1922 | Waller et al. | 30/418 |
| 1,935,680 | 11/1933 | Von Wolforsdorf . | |
| 2,486,314 | 10/1949 | Montgmery | 30/417 |
| 2,715,265 | 8/1955 | Hult | 30/417 |
| 3,006,070 | 10/1961 | Nordquist | 30/424 X |
| 3,110,962 | 11/1963 | Krist et al. | 30/418 |
| 3,510,941 | 5/1970 | Fyfe . | |
| 3,719,991 | 3/1973 | French . | |
| 4,251,917 | 2/1981 | Peres | 30/417 X |
| 4,782,594 | 11/1988 | Porucznik et al. . | |
| 5,121,546 | 6/1992 | Chong . | |
| 5,367,776 | 11/1994 | Chong . | |
| 5,802,725 | 9/1998 | Drifka et al. | 30/416 X |

FOREIGN PATENT DOCUMENTS

| | | | |
|---|---|---|---|
| 1318 | 5/1912 | United Kingdom | 30/418 |

*Primary Examiner*—Rinaldi I. Rada
*Assistant Examiner*—Boyer Ashley
*Attorney, Agent, or Firm*—Oyen Wiggs Green & Mutala

[57] ABSTRACT

A heavy duty industrial can opener operated by hand or by motor which accommodates various sizes of cans and cuts the outer seam wall of a can rather than the top lip of the can. The can opener includes a cutting wheel with a cutting edge and a traction wheel with a gripping surface. The cutting and traction wheels each have associated gears for rotating the wheels. The gear for the traction wheel is releasably engageable with the gear of the cutting wheel. One of the gears is driven to rotate both the cutting and traction wheels. A cam lock provides a series of levers and link pins the ability to releasably engaged and disengaged the gears. The distance between the cutting wheel and the traction wheel is automatically adjusted while the cam is locked in place.

18 Claims, 7 Drawing Sheets

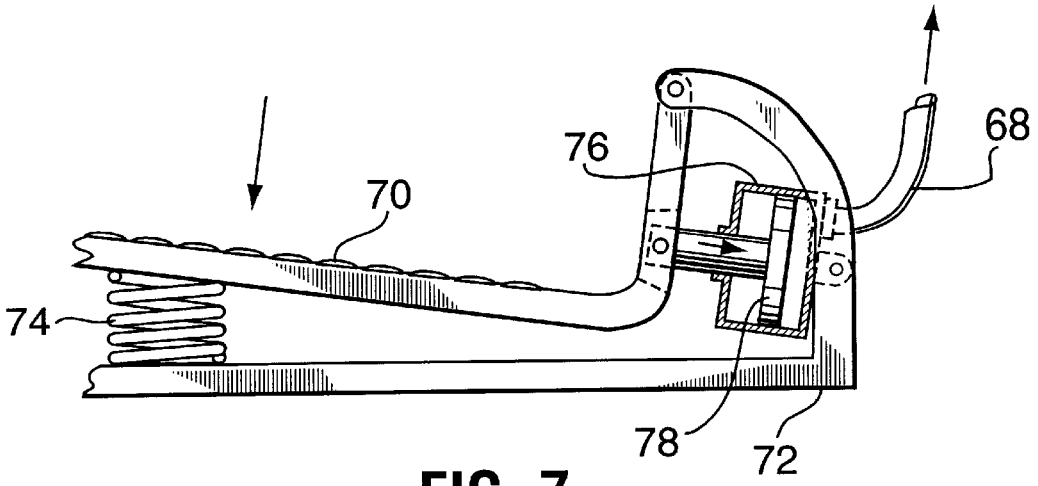
FIG. 7
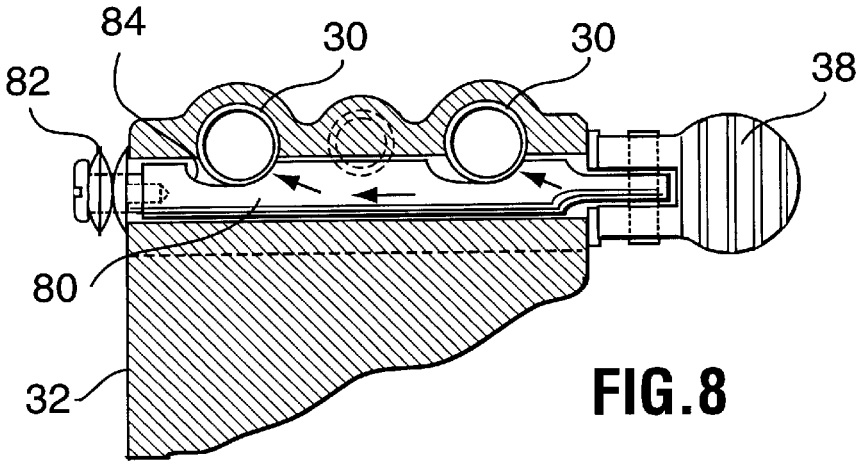
FIG. 8
FIG. 9
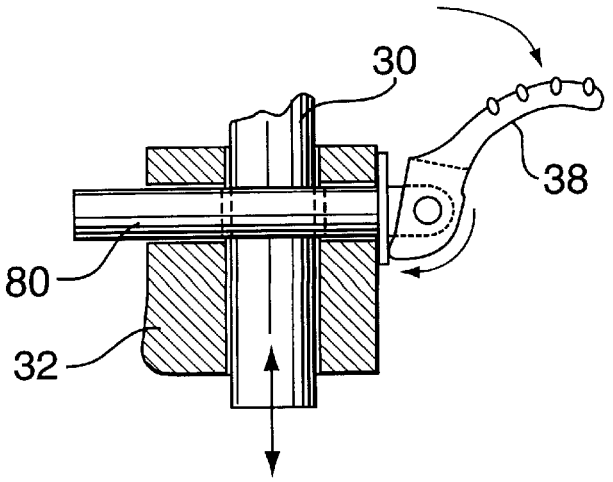

INDUSTRIAL CAN OPENER

FIELD OF THE INVENTION

This invention relates to a novel industrial can opener. More particularly, the invention is directed to a novel heavy duty industrial can opener which can be operated by hand or by motor, accommodates various sizes of cans and cuts the outer seam wall of a can, rather than the top lid of the can.

BACKGROUND OF THE INVENTION

Can openers used for opening cans of preserved produce are well known. In general, they cut the lid of the can by utilizing a combination of a traction wheel and a cutting wheel. The traction wheel is usually driven and acts as a reaction surface against the can wall or can seam. It acts to drive the can opener around the top lip (seam) of the can while the sharpened cutting wheel rotates and cuts through the can.

The most common type of can opener available is the one that cuts the top lid of the can at a location inside the top circumferential seam of the can. The disk-like cut lid is then removed to gain access to the can contents through the top of the can. A serious problem with this mode of opening a can is that the cutting blade cuts down through the circumference of the circular lid and tends to contact the sterilized preserved contents of the can. This is a problem if the cutting blade is contaminated from previous use and bacteria and debris have accumulated on the cutting blade. Another problem with this type of can opener is if the cutting blade is not particularly sharp, it will not cut the lid cleanly. Small metal shavings and cuttings are created and they fall into and contaminate the contents of the can. A further problem is that if the entire circumference of the circular top can lid is cut, the lid with its contaminated exterior side often falls into the can and contaminates the contents. Also, the lid can often be difficult and messy to remove from the interior of the can.

To address these problems, can openers have been developed that are designed to cut the outside seam of the can, rather than the lid. Examples of these can openers include U.S. Pat. No. 3,719,991 to French; U.S. Reissued Pat. No. 27,504 to Smith; U.S. Pat. No. 1,935,680 to Von Wolforsdorf; U.S. Pat. No. 4,782,594 to Porucznik et al. and U.S. Pat. No. 3,510,941 to Fyfe. All these patents disclose a can including a pin sliding in an arcuate slot for engaging and locking the can opener on the can to be opened. While these arrangements work adequately, over time there is a tendency for the moving parts to wear.

The result is that the engaging and locking function of the opener is impaired thereby leading to difficulty in cutting the can and keeping the opener in position on the can.

U.S. Pat. No. 5,121,546, granted Jun. 16, 1992, to the subject inventor, Wun C. Chong, discloses an effective solution of the above discussed wear problem. In the can opener disclosed in U.S. Pat. No. 5,121,546, there are thrust surfaces and a separating mechanism that can be introduced between the thrust surfaces. The separating mechanism, typically a ball bearing, is introduced between the thrust surfaces and moves a movable thrust surface away from a fixed thrust surface to separate a movable wheel, usually the traction wheel, and a cutting wheel. Using this mechanism, the can opener is brought to the cutting position. The traction wheel can then be rotated to cut the seam of the can. While the can opener disclosed in my U.S. Pat. No. 5,121,546 has proved to be extremely effective, experiments with various groups of operators have shown that a certain manual dexterity is required in order to effectively operate the can opener.

U.S. Pat. No. 5,367,776, granted Nov. 29, 1994, to the subject inventor, Wun C. Chong, discloses a design of can opener comprising a housing having a manually operable handle. The cutting wheel has a cutting edge for severing the seam of the can wall, with the cutting wheel defining a cutting wheel axis. The can opener also has a traction wheel which has a gripping surface. This gripping surface engages the can with the traction wheel defining a traction wheel axis. The can opener also includes a mechanism for rotatably mounting the traction wheel and the cutting wheel in the housing such that their respective axes of rotation are substantially perpendicular and the wheels are positioned adjacent and spaced apart from each other to define a gap to accept the seam of the can to be opened. One of the wheels is movable towards the other wheel in order to engage and lock the can between the cutting wheel and the traction wheel so that the cutting wheel acts to sever the seam of the can wall. The traction wheel acts to move the can past the cutting wheel.

A first thrust surface is associated with the housing and a spaced, adjacent, second thrust surface is associated with the moveable wheel. The first and second thrust surfaces comprise cooperable cam surfaces which are rotatable relative to each other to reciprocate the first and the second thrust surfaces relative to each other between a first position, where the gap between the two surfaces is relatively wide, and a second position where the gap between the two surfaces is narrow and the can is engaged and locked between the cutting wheel and the traction wheel. A handle is associated with one of the wheels to enable the wheel to be manually rotated.

SUMMARY OF THE INVENTION

The invention is directed to a can opener comprising: (a) a cutting wheel having a cutting edge for severing a can seam of a can, said cutting wheel defining a cutting wheel axis; (b) a traction wheel having a gripping surface for engaging a side of the can seam opposite the cutting wheel, said traction wheel defining a traction wheel axis; (c) a first member associated with said cutting wheel for rotating said cutting wheel; (d) a second member associated with said traction wheel for rotating said traction wheel, said second member being releasably engageable with said first member; (e) a third member for driving the first member or the second member; and (f) a fourth member for engaging or disengaging the first member from the second member, the cutting wheel axis and the traction wheel axis being substantially parallel when the first member is engaged with the second member.

The first and second members can be gears and the third member can drive both the first gear and the second gear in a counter direction to each other. The fourth member, when moved to a first position, can releasably engage the first gear and the second gear, and when moved to a second position, can releasably disengage the first gear from the second gear, the fourth member being connected to the first gear or the second gear by a plurality of levers and link pins.

The can opener can include a mechanism for enabling the distance between the cutting wheel and the traction wheel to be adjusted. The can opener can include a universal joint connecting the third member with the cutting wheel and a universal joint connecting the fourth member with the traction wheel. The can opener can include a spring mechanism for enabling the distance between the cutting wheel and the traction wheel to be varied to adjust to differences in widths of can seam.

The can opener can include a cam in the levers and link pins which can releasably lock in place against a cam bearing surface to thereby hold the cutting wheel and the traction wheel in position when the first gear and the second gear are engaged with one another. The can opener can include a motor which when activated, can drive the first gear and the second gear in counter rotation when the first gear and the second gear are engaged with one another.

The can opener can include a hydraulic cylinder which can be activated by a foot pedal, causing the first gear and the second gear to engage with one another. The cutting wheel, the traction wheel, the first gear, the second gear, the third member and the fourth member of the can opener can be associated with a housing. The axis for said cutting wheel and the axis for said traction wheel can comprise a pair of shafts rotatably mounted in said housing.

The can opener can include an abutment member for guiding the movement of said can opener about a can during the seam cutting operation. The abutment member can have a downwardly curved U-shape adapted to engage with a top of the can. The axis of the cutting wheel can be at an angle with respect to the plane of the top of a can. The cutting wheel can be rotationally mounted on a moveable carriage. The can opener can include a pair of idle rollers which can assist in holding a can in place during the seam cutting operation. The fourth member can disengage the first gear from the second gear by raising the first gear.

The can opener can be mounted on a post and the elevation of the can opener on the post can be adjusted. The foot pedal can activate a hydraulic cylinder which, through an oil line, can activate a second cylinder which can cause the can opener to close on the seam of a can.

BRIEF DESCRIPTION OF THE DRAWINGS

In drawings which illustrate specific embodiments of the invention, but which should not be construed as restricting the spirit or scope of the invention in any way:

FIG. 7 illustrates a front view of a hydraulic foot pedal for operating the motor driven version of the can opener.

FIG. 8 illustrates a top detail section view of the clamp arm lock lever mechanism.

FIG. 9 illustrates a detail front view of the clamp arm lock lever mechanism positioned on a post.

DESCRIPTION OF PREFERRED EMBODIMENTS OF THE INVENTION

Figure 1:
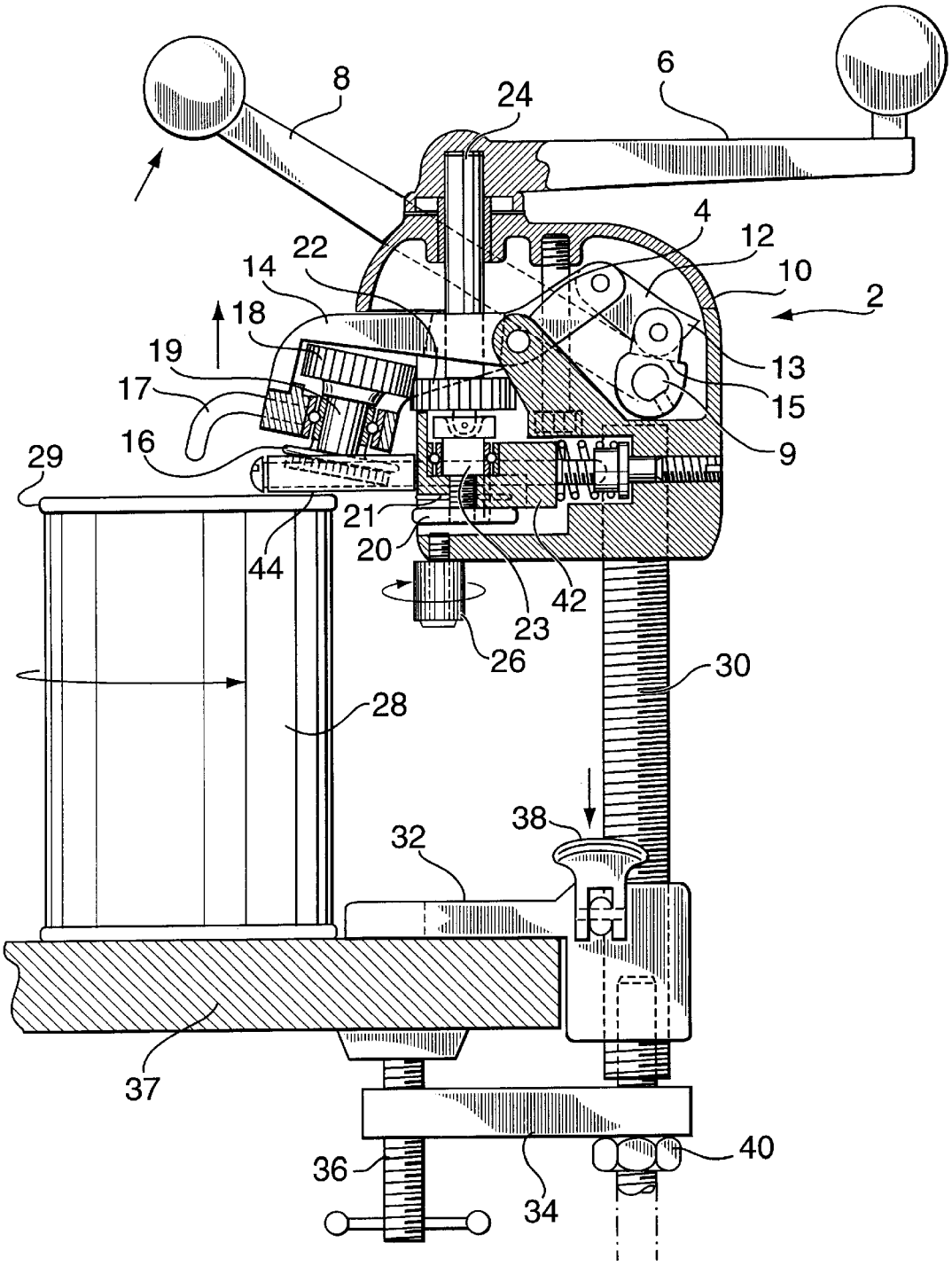
FIG. 1 illustrates a side partial section view of a manually operable embodiment of the industrial can opener, with the opener in an open can receiving position.

The industrial can opener according to the present invention utilizes can seam cutting components which are somewhat similar in construction to those which were disclosed and illustrated in my prior U.S. Pat. No. 5,367,776, granted Nov. 29, 1994. However, the subject industrial can opener has many innovative components which adapt it for heavy duty industrial use and provide a number of major advantages. The subject industrial can opener has both manually operable and motorized embodiments. In the manually operable version, the industrial can opener according to the invention includes a handle for opening or closing the opener on a can and a second rotary handle which can be rotated by the hand. Furthermore, the industrial can opener according to the invention, when closed on the top seam of a can, automatically engages the seam of the can by closing the open-close handle.

The industrial can opener according to the invention, unlike the design in U.S. Pat. No. 5,367,776, when in a closed position, has the traction wheel and cutting wheel in planar alignment and opposed to one another so that the traction wheel abuts the interior side of the seam and the cutting wheel abuts and cuts the exterior side of the seam of the can. With the subject invention, the aligned axis traction wheel on the inside of the seam, parallel and above the can lid, and the aligned axis cutting wheel on the exterior side of the can seam oppose and balance one another and the cutting edge of the cutting wheel penetrates directly into the exterior side of the can seam. When the operator rotates the rotary handle, the can opener proceeds smoothly around the circumference of the can seam, and cuts it. Since the cut lid has a diameter larger than the inside diameter of the can, the lid cannot drop into the interior of the can. Also, since the cutting wheel is at a lateral angle to the can seam, it severs the can seam, rather than cuts it, with the possibility that metal shavings will be generated. Even if metal shavings are created, they drop harmlessly to the exterior of the can.

The industrial can opener according to the invention incorporates a further major improvement over prior can opener designs, including the design in U.S. Pat. No. 5,367,776, because in a preferred embodiment both the traction wheel and the cutting wheel are driven by rotating the rotary handle. Thus the drive forces exerted on the can seam horizontally from each side are opposed and balanced and slippage on the can seam, which can cause metal shavings problems, is minimized. The opposed horizontal forces help maintain the can in a steady position and eliminate any twisting torque or squirming forces on the can seam as the rotary handle, in the manually operated embodiment, is rotated. The industrial can opener also incorporates another important advantage by including a pair of idle rollers which ride against the upper exterior can wall, below the can seam. This pair of idle rollers assists in holding the can in position during the can rotation cutting process. The result is that a smooth clean cut of the exterior circumference of the can seam is made.

The industrial can opener according to the manually operated embodiment of the invention is disengaged from the can seam, once the entire seam has been cut, by lifting the open-close lever at the top of the industrial can opener. The industrial can opener includes a curved U-shaped, downwardly extending can abutment member which at its distal end descends below the elevation of the can seam, immediately above the top lid, and assists in aligning the opener on the can so that an accurate and clean cut of the can seam can be made. The curved abutment member also assists in holding the can and seam in engagement with the industrial can opener, during the seam cutting process.

Figure 2:
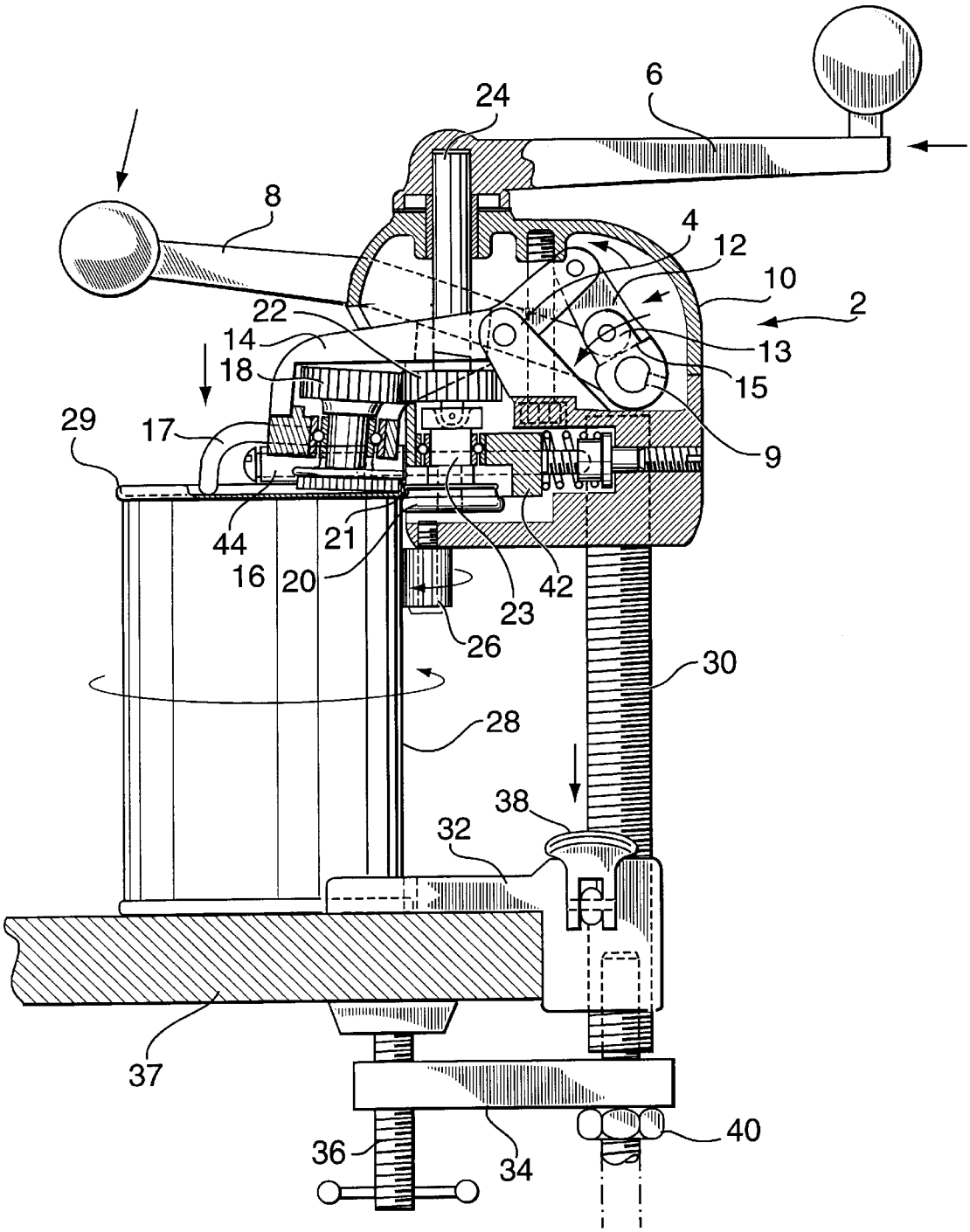
FIG. 2 illustrates a side partial section view of a manually operable embodiment of the industrial can opener, with the opener in a closed position about a can, ready for cutting the seam of the can.

FIGS. 1 to 4 illustrate a manually operated embodiment of the industrial can opener. FIG. 1 illustrates a side partial section view of the industrial can opener 2 which comprises a housing 10 which has above it a rotary crank 6 and a raise and lower lever 8 for opening and closing a traction wheel 16 and cutting wheel 20 upon the can seam 29. The cutting wheel 20 with a cutting edge 21 for severing the exterior side of the top seam 29 of the can wall 28, is shown in detail in FIGS. 3 and 4. The cutting wheel 20 is mounted on a rotatable spindle shaft 23 that defines a cutting wheel axis. The traction wheel 16 has a can seam gripping surface in the form of teeth as shown particularly in FIG. 3. The traction wheel 16 is mounted on a second rotatable spindle shaft 19 that defines a traction wheel axis. The cutting wheel 20 and traction wheel 16 are rotationally mounted in housing 10 so that the respective spindle shafts 19 and 23, and thus the axes of rotation of wheels 16 and 20 (when in a lower position as shown in FIG. 2) are substantially perpendicular and parallel. A traction wheel gear 18 is mounted at the top of the spindle shaft 19 and a cutting wheel gear is mounted at the top of spindle shaft 23. The cutting and traction wheels 20 and 16 are positioned adjacent but spaced from each other to define a gap 25 (see FIG. 3) which is able to accept the can seam 29 of the can 28 to be opened.

FIGS. 1 and 2 also illustrate the mechanism and operation of the linkages between the raise and lower lever 8 and the vertically moveable traction wheel 16. As seen in FIG. 1, the lever 8 and traction wheel 16 are in a raised position, the pivot end 9 of lever 8 being connected by link arm 12 to horizontal traction wheel raise-lower arm 14. The end of the link arm 12 adjacent pivot end 9 has lock cam 13. The raise-lower arm 14 is mounted in rocking fashion on pivot mount 4. As also seen in FIG. 1, when the lever 8 is in a raised position, the traction gear 18 is raised and does not engage cutting wheel gear 22. The gap 25 between traction wheel 16 and cutting wheel 20 is at a maximum distance.

As seen in FIG. 2, the lever 8 and traction wheel 16 are in a lower position, and the lock cam 13 of link arm 12 is abutted against cam lock face 15 of the pivot end 9 of lever 8. This holds the separate parts of the linkage securely in place so that the traction wheel 16 and cutting wheel 20 abut both sides of the can seam 29 during the can seam 29 cutting procedure. The exterior of the can seam 29 is cut by cranking hand crank 6, which through cutting wheel rotation pin 24, causes engaged traction and cutting gears 18 and 22 to rotate in a counter direction. This in turn causes traction wheel 16 and cutting wheel 20 to rotate in counter direction whereby the cutting edge 21 of cutting wheel 20 severs the exterior of the can seam 29 around the circumference of the can 28.

When the lever 8 is lowered, the traction wheel 16 moves towards the cutting wheel 20 to close the gap 25. This engages and locks the traction wheel 16 and the cutting wheel 20 on each side of the top seam 29 of the can 28, as shown in FIG. 2. When can 28 is so engaged, the traction wheel 16 and the cutting wheel 20 are rotated in counter-directions by turning crank 6, which drives both traction wheel gear 18 and cutting wheel gear 22, which are engaged with one another in the lowered position (see FIG. 2). The cutting edge 21 of the cutting wheel 20, as seen most clearly in FIG. 4, severs the exterior side of the can seam 29 as the traction wheel 16 bears against the internal side of the seam 29 and acts to move the can 28 and seam 29 past the rotating cutting edge 21 of the cutting wheel 20.

FIGS. 1 and 2 also illustrate the manner in which the manually operated can opener 2 can be mounted on a table or bench 37. The housing 2 and the internal components including the linkages 12 and 14, and the traction wheel 16 and the cutting wheel 20, are mounted on a parallel pair of vertical posts 30. The bottom ends of the two posts 30 are mounted in an upper table clamp arm 32 which extends over the top of a table 37. A bottom clamp arm 34 with adjustable clamp 36 and adjustable position nut 40 are connected to the underside of upper clamp arm 32 and enable the can opener 2 to be mounted on the edge of a table or bench 37. The clamp includes a quick release clamp arm lock lever 38 which enables the top clamp arm 32 to be moved upwardly or downwardly on the pair of vertical posts 30.

Figure 3:
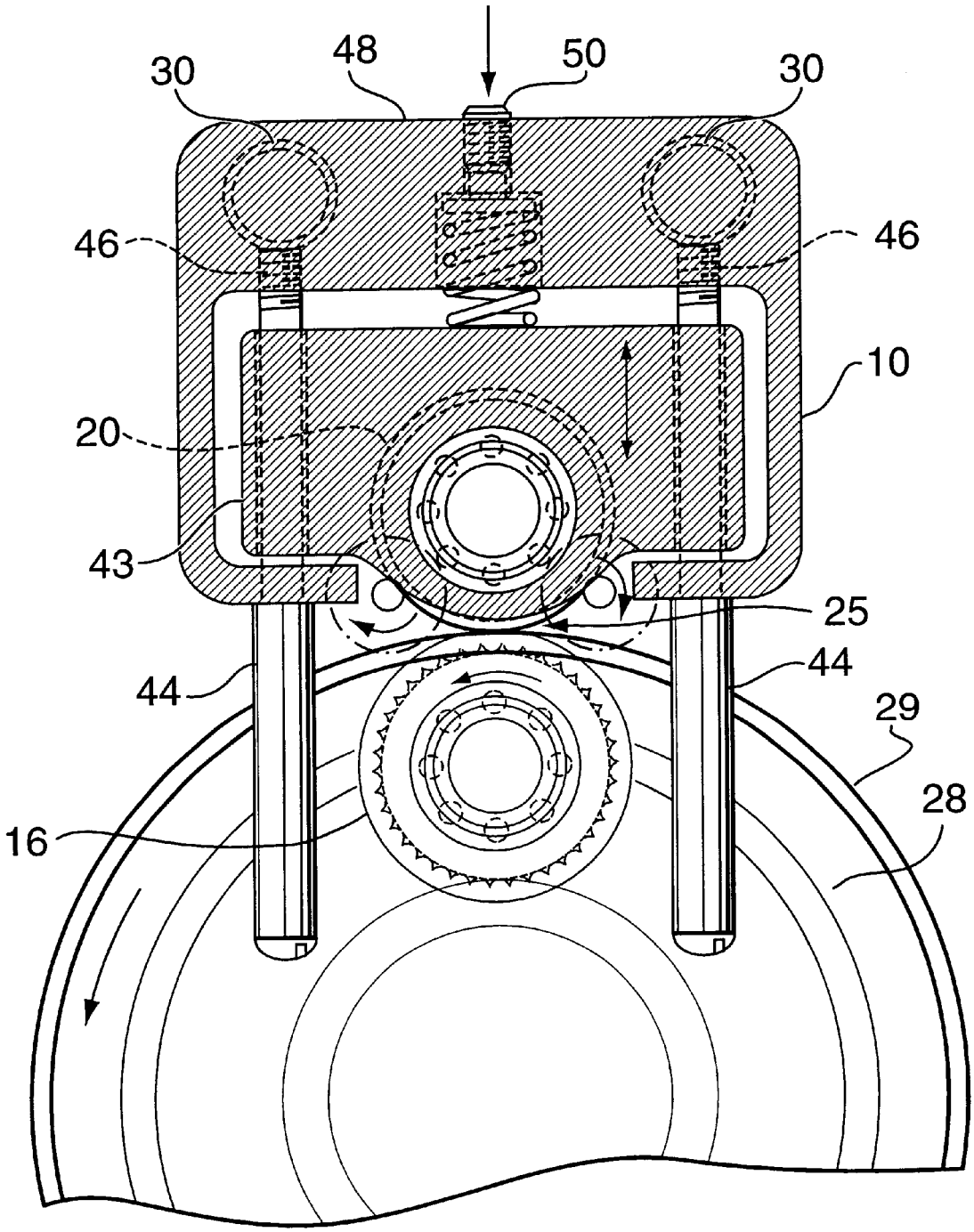
FIG. 3 illustrates a top section view taken along section line 3—3 of FIG. 4 of the traction wheel, the cutting wheel and the housing.
Figure 4:
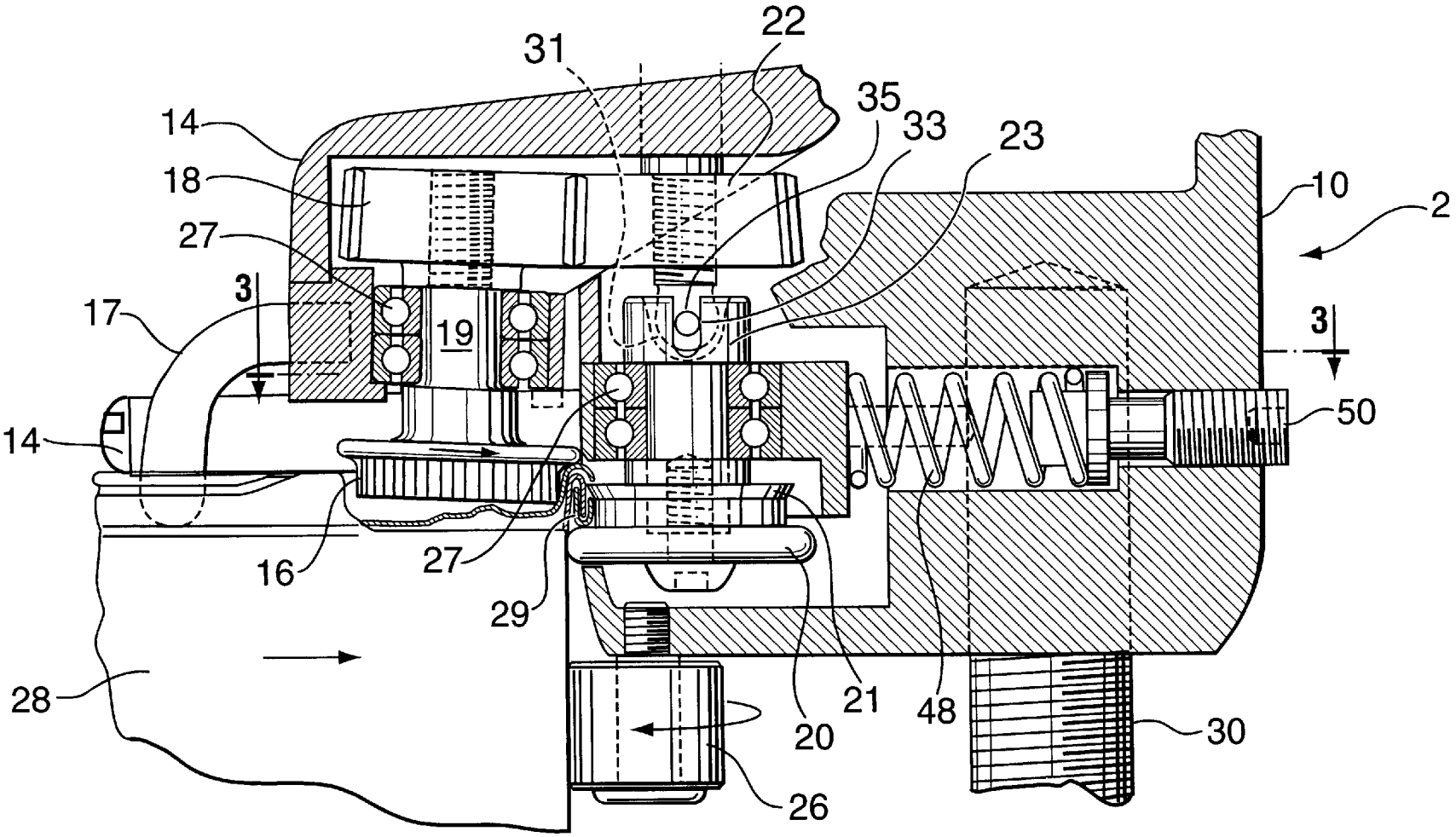
FIG. 4 illustrates a detail side partial section view of the traction wheel and the cutting wheel in a closed position cutting the top seam of a can.

As seen particularly in FIGS. 3 and 4, the gap 25 width is adjustable and can accommodate different widths of can seam 29 because the cutting wheel 20 is rotationally mounted on mounting block 42 which is movable along the pair of parallel slide rods 44 towards traction wheel 16 as indicated by the double-headed arrow in FIG. 3. Traction wheel 16, on the other hand, is stationary in a horizontal direction, but can be moved upwardly or downwardly by raising or lowering lever 8 (see FIGS. 1 and 2). The position of the cutting wheel 20 and mounting block 42 relative to traction wheel 16 can be adjusted by using a screwdriver and rotating the pair of slide rods 44, which are threaded into housing 10 by threads 46 (see FIG. 3), in the required direction.

FIG. 3 also illustrates how cutting wheel mounting block 42 can resistively slide on the pair of slide rods 44 by pushing against coil spring 48. This resilient action permits the gap 25 between cutting wheel 20 and traction wheel 16 to automatically adjust to accommodate variations in the thickness of can seam 29, since manufactured cans 28 often have slight variations in the width of the can seam 29. The position and compression force exerted by coil spring 48 on mounting block 42 can be adjusted by using set screw 50. FIG. 3 also illustrates a top view of the pair of vertical posts 30 against which the threaded ends of the pair of slide rods 44 abut.

As seen in FIGS. 1, 2 and 4, the U-shaped curved can abutment 17, in combination with the pair of idle rollers 26, secure the can 28 in rotational position and guides the rotational movement of the can 28 and can seam 29 relative to the can opener 2 during severing of the can seam 29. The U-shaped can abutment 17 borders cutting wheel 20 and traction wheel 16 and by being curved downwardly at its end engages the top surface of the can 28, as shown particularly in FIGS. 2 and 4. The U-shaped abutment means 17, in addition to bearing down on the top lid of can 28, assists in centering the can opener 2 and the traction wheel 16 on the can 28 so that a proper clean severance of the can seam 29 will always take place.

As shown particularly in section view in FIG. 4, the cutting wheel 20 is formed with cutting edge 21 and an underlying shoulder that abuts the exterior underside of the top seam 29 to thereby guide the cutting wheel 20 and hold it in position against can seam 29 as the cutting edge 21 penetrates and severs the can seam 29 into two parts (see FIG. 4). Idle rollers 26 also bear against the side wall of can 28 and hold it in place during the seam severing action.

The cutting wheel spindle shaft 23 (see FIG. 6) is preferably mounted at an angle to the vertical. This improves the engagement of the cutting edge 21 of the cutting wheel 20 with the can seam 29 and the cutting/severing action. An appropriate angle through a process of trial and error has been found to be about 12.5° from the vertical. The can 2 rotates in a counterclockwise direction as seen in FIG. 3, so that the can seam 29 is severed cleanly.

Referring to FIG. 4, which illustrates an enlarged detail partial side section view of the can opener 2 engaged in a seam severing orientation on a can 28, the traction wheel raise arm 14 is in lowered position, with the curved can abutment 17 resting on the top lid of the can 28. Traction wheel 16 is also in lowered position and abuts the inside edge of the can seam 29, while the cutting edge 21 of cutting wheel 20 severs the exterior rim of the can seam 29. FIG. 4 also illustrates in detail how traction wheel gear 18 on top of spindle shaft 19 engages with cutting wheel gear 22 which is universally connected with cutting wheel spindle shaft 23. The traction wheel 16 and shaft 19 are rotatably mounted with ball bearings 27, while cutting wheel 20 and shaft 23 are also rotatably mounted with ball bearings 27. Screw-driver adjustable mounting block slide rod 44, in combination with coil spring 48 and set screw 50, is also illustrated in detail. An important feature of the can opener 2 that is illustrated in FIG. 4 is the existence of a universal joint 31, which is built into cutting wheel spindle shaft 23. This universal joint 31 enables cutting wheel spindle shaft 23, cutting wheel block 42 and cutting wheel 20 to move on the pair of slide rods 44 towards or away from traction wheel 16. Thus cutting wheel gear 22 above the universal joint 31 remains in position relative to traction wheel gear 18 and there is therefore no gear clashing or damage when the traction and cutting gears 18 and 22 engage with and disengage from one another. Universal joint 31 includes a pin 33 which fits in a slot 35. Thus, to provide flexibility, the universal joint 31 can move upwardly or downwardly to a certain extent, while at the same time, pivoting about the pin 33 and slot 35.

Figure 5:
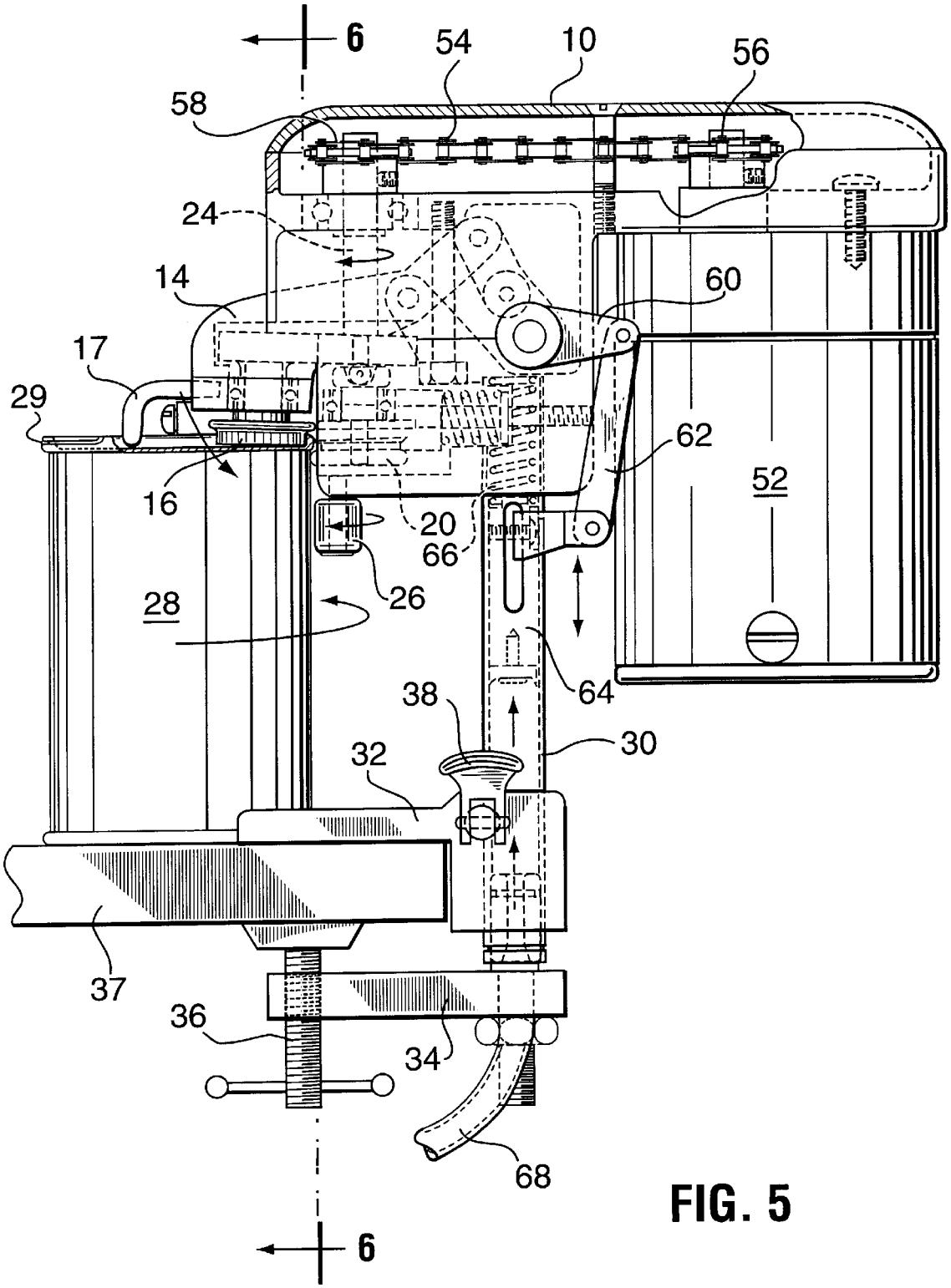
FIG. 5 illustrates a side partial section view of a motor driven and foot operated embodiment of the industrial can opener, with a can in position for cutting.
Figure 6:
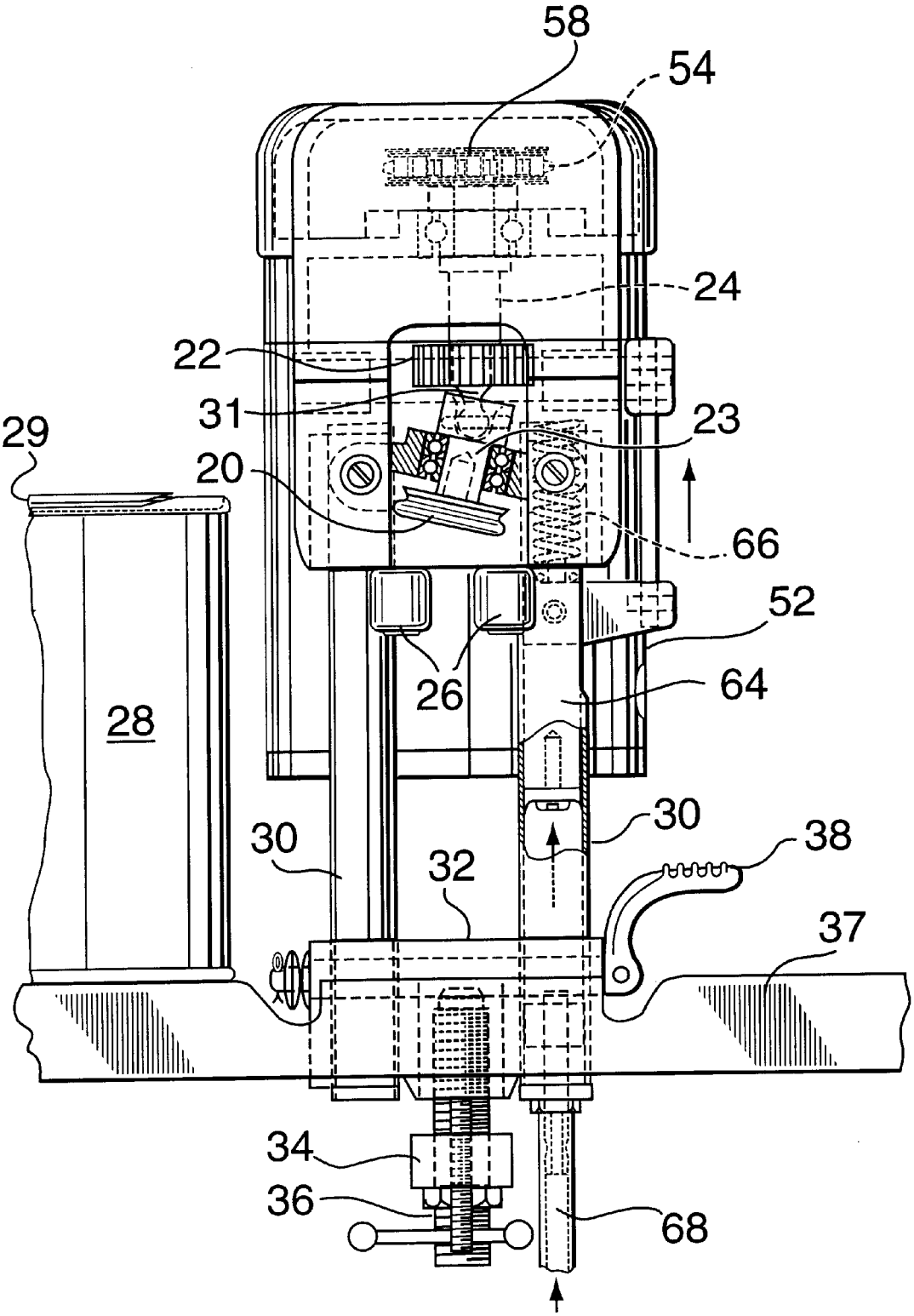
FIG. 6 illustrates a front partial section view of a motor driven and foot operated embodiment of the industrial can opener, with a can being moved into position from the side.

FIGS. 5, 6 and 7 illustrate a motorized foot pedal operated embodiment of the invention. FIGS. 5 and 6 illustrate respectively side and front views of the motor driven, foot operated embodiment of the industrial can opener. As seen in FIG. 5, the basic seam cutting and linkage components of the power driven can opener are the same as described previously in association with the manually operated can opener illustrated and discussed in relation to FIGS. 1 to 4. This includes the traction wheel raise arm 14, the traction wheel 16, the cutting wheel 20, the curved can abutment 17, and the cutting wheel rotation pin 24. Likewise, the pair of vertical posts 30, the upper table clamp arm 32, the bottom clamp arm 34, the hand adjustable clamp 36 and the clamp arm lock lever 38 are the same in the motorized embodiment as in the manually operated embodiment. However, in the motorized embodiment illustrated in FIGS. 5 and 6, the raise and lower lever 8 is replaced with a combination of a raise-lower lever 60 and a link pin 62. Similarly, in place of hand crank 6, an electrical motor 52 is connected by a standard reduction gear system (not illustrated) to a sprocket 56 which drives a chain 54. Chain 54 is linked at its opposite end to a rotation pin sprocket 58 which is connected to the top of cutting wheel rotation pin 24, which is of the same general construction as in the manual embodiment of the can opener. Thus, when power to the electric motor 52 is turned on, such as by a hand or foot operated electrical switch, the electric motor 52 via chain drive 54 and rotation pin 24, drives the traction wheel 16 and the cutting wheel 20 in counter direction in the same manner as described previously in association with the manually operated can opener previously discussed and illustrated in FIGS. 1 to 4.

Referring to FIG. 5, the traction wheel raise arm 14 is linked by raise-lower lever 60, and link pin 62, to a hydraulic cylinder 64 which is mounted in one of the hollow vertical posts 30. Hydraulic cylinder 64 is operated by a foot pedal 70 which is positioned under the table or bench 37. The foot pedal 70 is connected via oil line 68 to the hydraulic cylinder 64. Hydraulic pressure generated by downwardly depressing the foot pedal 70 is sufficient to force the piston in hydraulic cylinder 64 upwardly. This in turn moves link pin 62, and raise-lower lever 60 upwardly and lowers traction wheel raise arm 14, and curved can abutment 17 onto the top of can 28. A return coil spring 66 is positioned above the hydraulic cylinder 64 and, when the hydraulic pressure is released by releasing the pressure on the foot pedal 70, returns the link pin 62 to a lower position. An operator can therefore, by using the foot pedal 70 and an electric switch (not shown), operate the motorized can opener quickly and efficiently, such as in the environment of an assembly line.

FIG. 6 illustrates a section view taken along section line 6—6 of FIG. 5. FIG. 6 illustrates the motor 52, the pair of idle rollers 26, the 12.5° angled cutting wheel 20, the universal joint 31, the cutting wheel gear 22, the cutting wheel rotation pin 24, and the chain 54 on the cutting wheel sprocket 58. In FIG. 6, the can 28 is being shown as being introduced from the side. This is basically for illustration purposes only. In normal practice, the can 28 is usually introduced to the can opener 2 from the front of the can opener 2. The can 28, shown in FIG. 6, also illustrates the severance cut that is made by cutting wheel 20 on the exterior of the can seam 29.

FIG. 7 illustrates a front view of a hydraulic foot pedal for operating the motor driven version of the can opener. As seen in FIG. 7, the foot pedal 70 is hingedly mounted to a foot pedal base 72. When the foot pedal 70 is depressed downwardly (as indicated by the vertical arrow) it compresses the piston 78 in the hydraulic cylinder 76 and forces oil up the oil line 68, as indicated by the upwardly extending arrow. Oil line 68 is of course connected to the oil line 68 that is illustrated in FIGS. 5 and 6. The pressurized oil then causes the can opener 2 to close on the can 28. When the operator releases pressure on the pedal 70, the pedal is forced upwardly by return spring 74 and pressure on the oil in line 68 is released. The can opener 2 then opens.

FIGS. 8 and 9 illustrate respectively a top detail section view of the clamp arm lock lever mechanism, and a detail front view of the clamp arm lock lever mechanism positioned on a post. As seen in FIG. 8, clamp shaft 80 has offset indentations 84 which are adjacent posts 30. When the clamp lever 38 is in an upwardly position, as seen in FIG. 9, the cup springs 82 force the clamp shaft 80 to the left as seen in FIG. 8, and the offset indentations 84 bear against the respective posts 30 and hold the can opener at the given elevation on the posts 30. When the operator wants to adjust the elevation of the can opener 2 on the posts to accommodate a different height of can 28, the operator depresses clamp lever 38 and this moves the clamp shaft 80 to the right as seen in FIG. 8, and the offset indentations 84 release from the posts 30. Then once the new elevation is determined, the operator raises lever 38 to set the elevation.

METHOD OF OPERATION OF THE CAN OPENER

The industrial can opener according to the invention is easy to use in either the manual or motorized embodiments. In the manual version as illustrated in FIGS. 1 to 4, a can 28 is placed with the top seam 29 in the gap 25 when the can opener 2 is in an open position, as shown in FIG. 1. The raise and lower lever 8 is then lowered and through the series of link arms 12 and 14, the traction wheel 16 closes against the interior side of the seam 29, as illustrated in FIG. 2.

The can seam 29 is then ready for cutting. By cranking hand crank 6 in either a horizontal clockwise direction, the operator through traction wheel gear 18 and cutting wheel gear 22 causes traction wheel 16 and cutting wheel 20 to advance around the top seam 29 of the can 28 and cause cutting edge 21 to cut or sever the exterior side of seam 29 of the can 28. Once the circumference of the seam 29 of the can 28 has been cut, the operator is ready to detach the opener 2 from the can 28. This is done by raising the lever 8, which widens the gap 25 and permits the can 28 and cut lid to be removed from the opener 2.

In the motorized embodiment as illustrated in FIGS. 5 to 7, the can seam 29 is inserted in the gap 25, the operator closes the gap 25 by depressing the foot pedal 70, and the can seam 29 is cut by throwing an electrical switch (not shown) which activates the electric motor 52. The can 28, once the seam 29 has been cut, is released from the opener 2 by releasing the depressing force on the foot pedal 70. The can 28 and cut lid can then be removed from the opener.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A can opener comprising:

(a) a cutting wheel having a cutting edge for severing a first side of a can seam of a can, said cutting wheel defining a cutting wheel axis;

(b) a traction wheel having a gripping surface for engaging a second side of the can seam opposite the cutting wheel, said traction wheel defining a traction wheel axis;

(c) a first member associated with said cutting wheel for rotating said cutting wheel;

(d) a second member associated with said traction wheel for rotating said traction wheel, said second member being releasably engageable with said first member;

(e) a third member associated with said first member or said second member for driving said first member or said second member;

(f) a fourth member for engaging and disengaging said first member from said second member, wherein the fourth member, when moved to a first position, releasably engages the first member and the second member, and when moved to a second position, releasably disengages the first member from the second member, said fourth member being connected to the first member or the second member by a plurality of levers and link pins, the cutting wheel axis and the traction wheel axis being substantially parallel when the first member is engaged wit the second member;

(g) a cam in the levers and link pins which releasably locks in place against a cam bearing surface to hold the first member and the second member in engagement with one another; and (h) mechanism for enabling a distance between he cutting wheel and the traction wheel to be automatically adjusted while the cam is locked in place against the cam bearing surface.

2. A can opener as claimed in claim 1 wherein the first member is a first gear and the second member is a second gear.

3. A can opener as claimed in claim 1 including a universal joint connecting the third member with the cutting wheel.

4. A can opener as claimed in claim 1 including a universal joint connecting the fourth member with the traction wheel.

5. A can opener as claimed in claim 1 including a spring mechanism for enabling the distance between the cutting wheel and the traction wheel to be varied to adjust to differences in widths of can seam.

6. A can opener as claimed in claim 1 wherein the axis of said cutting wheel is at an angle with respect to a plane of the top of the can.

7. A can opener as claimed in claim 1 wherein the cutting wheel is rotationally mounted on a moveable carriage.

8. A can opener as claimed in claim 1 including a pair of idle rollers which assist in holding the can in place during a seam cutting operation.

9. A can opener as claimed in claim 1 wherein the can opener is mounted on a post and an elevation of the can opener on the post can be adjusted.

10. A can opener as claimed in claim 1 including a hydraulic cylinder which is activated by a foot pedal, and causes the first gear and the second gear to engage with one another.

11. A can opener as claimed in claim 10 wherein the foot pedal activates the hydraulic cylinder which, through an oil line, activates a second cylinder which causes the can opener to close on the seam of the can.

12. A can opener as claimed in claim 1 including an abutment member for guiding the movement of said can opener about the can during a seam cutting operation.

13. A can opener as claimed in claim 12 wherein the abutment member has a downwardly curved U-shape adapted to engage with a top of the can.

14. A can opener as claimed in claim 2 wherein the third member drives both the first gear and the second gear in a counter direction to each other when the first gear and the second gear are engaged with each other.

15. A can opener as claimed in claim 2 including a motor which, when activated, drives the first gear and the second gear in counter rotation when the first gear and the second gear are engaged with one another.

16. A can opener as claimed in claim 2 wherein the fourth member disengages the first gear from the second gear by raising the first gear.

17. A can opener as claimed in claim 2 wherein the cutting wheel, the traction wheel, the first gear, the second gear, the third member and the fourth member are associated with a housing.

18. A can opener as claimed in claim 17 wherein the axis for the cutting wheel and the axis for the traction wheel comprise a pair of shafts rotatably mounted in the housing.

* * * * *